US008916325B2

(12) United States Patent
Yaguchi et al.

(10) Patent No.: US 8,916,325 B2
(45) Date of Patent: Dec. 23, 2014

(54) CARRIER FOR DEVELOPING ELECTROSTATIC LATENT IMAGE, TOW-COMPONENT DEVELOPER AND IMAGE FORMING METHOD

(71) Applicants: Shigenori Yaguchi, Shizuoka (JP); Hiroshi Tohmatsu, Shizuoka (JP); Koichi Sakata, Shizuoka (JP); Hitoshi Iwatsuki, Shizuoka (JP); Hiroyuki Kishida, Shizuoka (JP); Toyoaki Tano, Shizuoka (JP)

(72) Inventors: Shigenori Yaguchi, Shizuoka (JP); Hiroshi Tohmatsu, Shizuoka (JP); Koichi Sakata, Shizuoka (JP); Hitoshi Iwatsuki, Shizuoka (JP); Hiroyuki Kishida, Shizuoka (JP); Toyoaki Tano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 14 days.

(21) Appl. No.: 13/790,347

(22) Filed: Mar. 8, 2013

(65) Prior Publication Data

US 2013/0252169 A1 Sep. 26, 2013

(30) Foreign Application Priority Data

Mar. 21, 2012 (JP) ..... 2012-063204

(51) Int. Cl.

| | |
|---|---|
| ***G03G 9/00*** | (2006.01) |
| ***G03G 9/107*** | (2006.01) |
| ***G03G 7/00*** | (2006.01) |
| ***G03G 9/113*** | (2006.01) |

(52) U.S. Cl.

CPC ..... *G03G 7/008* (2013.01); *G03G 9/1075* (2013.01); *G03G 9/1139* (2013.01); *G03G 9/1136* (2013.01); *G03G 9/1133* (2013.01)

USPC ..... 430/111.35; 430/111.3

(58) Field of Classification Search

USPC ..... 430/111.3, 111.35, 124.1

See application file for complete search history.

(56) References Cited

U.S. PATENT DOCUMENTS

| | | | |
|---|---|---|---|
| 2007/0015078 | A1 | 1/2007 | Suzuki et al. |
| 2009/0232532 | A1 | 9/2009 | Sakata et al. |
| 2011/0086307 | A1 | 4/2011 | Nakajima et al. |
| 2011/0091802 | A1 | 4/2011 | Takahashi et al. |
| 2011/0171573 | A1 | 7/2011 | Sakata et al. |
| 2012/0028183 | A1 | 2/2012 | Nakajima et al. |
| 2012/0057898 | A1 | 3/2012 | Sakata et al. |
| 2012/0058423 | A1 | 3/2012 | Yamaguchi et al. |
| 2012/0064451 | A1 | 3/2012 | Kishida et al. |

(Continued)

FOREIGN PATENT DOCUMENTS

| | | |
|---|---|---|
| EP | 1 657 596 A1 | 5/2006 |
| JP | 7-077842 | 3/1995 |

(Continued)

OTHER PUBLICATIONS

Extended Search Report issued Jun. 20, 2013 in European Application No. 13159578.7.

*Primary Examiner* — Thorl Chea

(74) *Attorney, Agent, or Firm* — Oblon, Spivak, McClelland, Maier & Neustadt, L.L.P.

(57) ABSTRACT

A carrier for developing electrostatic latent image, including a particulate magnetic core material; and a coated layer covering the surface of the particulate magnetic core material, wherein the coated layer includes a resin including a silicone resin and a methacrylic ester or an acrylic ester resin, and a filler including a substrate; and an electroconductive layer comprising tin dioxide ($SnO_2$), overlying the substrate, and wherein the carrier includes tin (Sn) in an amount not less than 0.5% by atom and has a ratio (Sn/Si) of tin (Sn) to silicon (Si) of from 0.03 to 0.2 when subjected to an XPS analysis.

9 Claims, 4 Drawing Sheets

(56) References Cited

U.S. PATENT DOCUMENTS

| | | | |
|---|---|---|---|
| 2013/0016999 | A1 | 1/2013 | Tohmatsu et al. |
| 2013/0065171 | A1 | 3/2013 | Yaguchi et al. |
| 2013/0065175 | A1 | 3/2013 | Sakata et al. |

FOREIGN PATENT DOCUMENTS

| | | |
|---|---|---|
| JP | 7-175257 | 7/1995 |
| JP | 7-175266 | 7/1995 |
| JP | 10-301338 | 11/1998 |
| JP | 11-202630 | 7/1999 |
| JP | 2006-154019 | 6/2006 |
| JP | 2006-163368 | 6/2006 |
| JP | 2007-058138 | 3/2007 |
| JP | 2008-224996 | 9/2008 |
| JP | 2009-009000 | 1/2009 |
| JP | 2009-217055 | 9/2009 |
| JP | 2009-217059 | 9/2009 |
| JP | 2010-217440 | 9/2010 |
| JP | 2011-059519 | 3/2011 |
| JP | 2011-145397 | 7/2011 |
| JP | 2011-209678 | 10/2011 |

CARRIER FOR DEVELOPING ELECTROSTATIC LATENT IMAGE, TOW-COMPONENT DEVELOPER AND IMAGE FORMING METHOD

CROSS-REFERENCE TO RELATED APPLICATIONS

This patent application is based on and claims priority pursuant to 35 U.S.C. §119 to Japanese Patent Application No. 2012-063204, filed on Mar. 21, 2012 in the Japan Patent Office, the entire disclosure of which is hereby incorporated by reference herein.

BACKGROUND OF THE INVENTION

1. Field of the Invention

The present invention relates to a carrier for developing electrostatic latent images for use in electrophotographic methods and electrostatic recording methods, a two-component developer and an image forming method using the carrier.

2. Description of the Related Art

In electrophotographic image formation, an electrostatic latent image is formed on an image bearing member comprising a photoconductive material, and the electrostatic latent image is developed into a toner image with a charged toner. The toner image is then transferred onto and fixed on a recording medium. In the field of electrophotography, full-color copiers and printers have been brought to the mainstream in place of monochrome copiers and printers recently.

In a typical full-color image formation, toner layers of yellow, magenta, cyan, and optional black are superimposed on one another to reproduce various colors, and the resulting composite toner image is finally fixed on a recording medium.

Conventionally, one-component developing methods, two-component developing methods and hybrid developing methods are used. In order to produce clear full-color images having good color reproducibility, a toner amount on an electrostatic latent image bearer needs maintaining faithfully to an electrostatic latent image, and the two-component developing methods are used in many cases for apparatuses required to produce high quality images at high speed.

When the toner amount on an electrostatic latent image bearer varies, the image density varies on a recording medium or color tone varies. The toner amount on an electrostatic latent image bearer varies because the toner charge quantity or the developer resistivity varies.

As the developer is used, a toner is spent on the surface of a carrier and occasionally varies in charge quantity. In this case, a resin having high water repellency is used in a coated layer of the carrier to prevent the toner from being spent, and Japanese published unexamined application No. JP-H11-202630-A discloses a method of adding a new carrier in a developer and discharge the spent carrier to prevent variation of charge quantity. Toner is likely to be spent in high density printing when a large amount of the toners are replaced.

A resin coated on a carrier is occasionally chipped by stirring stress of an image developer. When the resin coated layer is chipped and a core material is exposed, the carrier deteriorates in resistivity and image density deteriorates. In order to prevent the resin coated layer from being chipped, the resin coated layer is thickened or a large amount of fillers are mixed therein to increase strength thereof. A resin coated on a carrier is likely to be chipped when the number of printed sheets per 1 job is low because stirring time in an image developer becomes longer per one sheet, and in low-density printing because the carrier is not fed much.

As the filler mixed in the resin coated layer to control the resistivity of the carrier, an electroconductive material is used. Carbon black is mostly used as the electroconductive material. However, chipped resin coated layer mixes in color images, resulting in possible color contamination.

Japanese published unexamined application No. JP-2006-163368-A discloses a method of including a filler having an electroconductive coated layer formed of a tin dioxide layer and an indium oxide layer including tin dioxide in a resin coated layer to prevent the color contamination due to the chipped resin coated layer.

However, the filler surface resistivity is likely to increase after the indium oxide layer is worn out, resulting in high resistivity of the carrier. When a carrier has high resistivity, the developability deteriorates and the image density deteriorates. Thin lines and edges are highlighted in images, and when the toner concentration is increased to cover the deterioration of the image density, the toner is likely to scatter and cause background fouling.

Because of these reasons, a need exist for a carrier preventing deterioration of resistivity due to exposition of the core material even when the number of printed sheets per 1 job is low and in low-density printing, increase of resistivity due to chipped electroconductive layer of a filler included in a resin coated layer, and toner spent even in high-density printing.

SUMMARY OF THE INVENTION

Accordingly, one object of the present invention to provide a carrier preventing deterioration of resistivity due to exposition of the core material even when the number of printed sheets per 1 job is low and in low-density printing, increase of resistivity due to chipped electroconductive layer of a filler included in a resin coated layer, and toner spent even in high-density printing.

Another object of the present invention to provide a two-component developer using the carrier.

A further object of the present invention to provide an image forming method using the carrier.

These objects and other objects of the present invention, either individually or collectively, have been satisfied by the discovery of a carrier for developing electrostatic latent image, comprising:

a particulate magnetic core material; and a coated layer covering the surface of the particulate magnetic core material, wherein the coated layer comprises a resin comprising a silicone resin and a methacrylic ester or an acrylic ester resin, and a filler comprising:

a substrate; and an electroconductive layer comprising tin dioxide ($SnO_2$), overlying the substrate, and wherein the carrier comprises tin (Sn) in an amount not less than 0.5% by atom and has a ratio (Sn/Si) of tin (Sn) to silicon (Si) of from 0.03 to 0.2 when subjected to an XPS analysis.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a carrier preventing deterioration of resistivity due to exposition of the core material even when the number of printed sheets per 1 job is low and in low-density printing, increase of resistivity due to chipped electroconductive layer of a filler included in a resin coated layer, and toner spent even in high-density printing.

More particularly, the present invention relates to a carrier for developing electrostatic latent image, comprising:

a particulate magnetic core material; and a coated layer covering the surface of the particulate magnetic core material, wherein the coated layer comprises a resin comprising a silicone resin and a methacrylic ester or an acrylic ester resin, and a filler comprising:

a substrate; and an electroconductive layer comprising tin dioxide ($SnO_2$), overlying the substrate, and wherein the carrier comprises tin (Sn) in an amount not less than 0.5% by atom and has a ratio (Sn/Si) of tin (Sn) to silicon (Si) of from 0.03 to 0.2 when subjected to an XPS analysis.

The carrier of the present invention prevents resistivity variation regardless of printing density and stably produces quality images. When the printing density is high, a fresh toner is fed to a developer and an external additive or a toner is likely to be spent on the surface of the carrier. When the number of printed sheets per one job is low or in low density printing, the resin coated layer is likely to be shipped due to developing stress.

The carrier of the present invention does not quickly increase in resistivity, and the image density is difficult to deteriorate.

When the carrier includes Sn in an amount not less than 0.5% by atom when subjected to an XPS (X-ray photoelectron spectroscopy) analysis, electroconductivity on the surface of the carrier maintains resistivity thereof, prevents a toner charge quantity from increasing, and increases durability of the coated layer to prevent the layer from being chipped when used in image developer for long periods.

Figure 7:
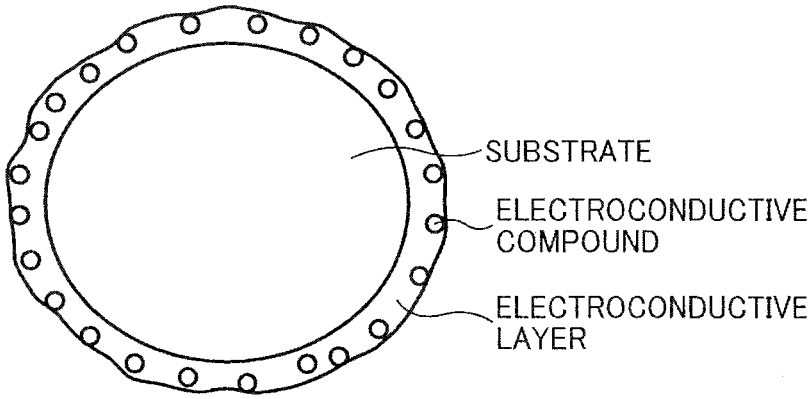
FIG. 7 is a schematic view illustrating a conventional electroconductive filler.
Figure 8:
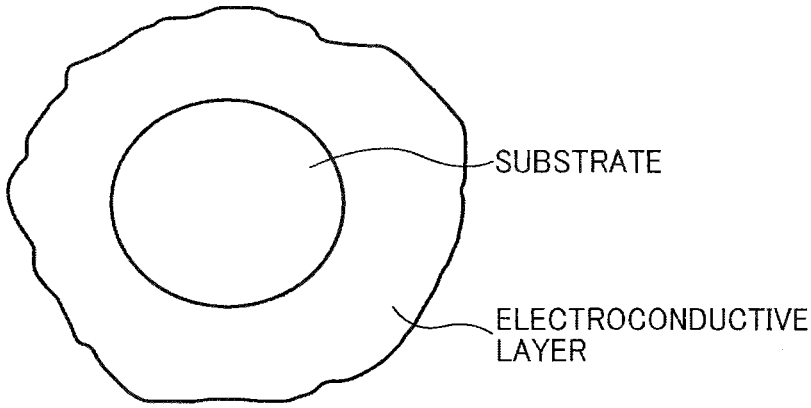
FIG. 8 is a schematic view illustrating an electroconductive filler in the present invention.

The resin coated layer is likely to be chipped when the number of printed sheets is low per one job and in low-density printing. The filler is chipped as well when the resin coated layer is chipped. When the filler has an electroconductive layer on its surface, the substrate is exposed when the electroconductive layer is worn out and the resistivity quickly increases. As FIG. 7 shows, an electroconductive filler having an $InO_2$—Sn electroconductive layer including a particulate electroconductive compound ($InO_2$) on its substrate quickly increases in resistivity when the $InO_2$—Sn electroconductive layer is worn out. As a result, the carrier increase in resistivity and the image density deteriorates. As FIG. 8 shows, the carrier of the present invention has an electroconductive layer including at least $SnO_2$ on its substrate and includes Sn in an amount not less than 0.5% by atom when subjected to an XPS analysis to prevent the resistivity from increasing even when the electroconductive layer is worn out.

Meanwhile, when a carrier includes a filler too much in its surface, a resin on the surface thereof relatively decreases and a toner is likely to be spent thereon. Therefore, a carrier having a ratio (Sn/Si) of tin (Sn) to silicon (Si) of from 0.03 to 0.2 when subjected to an XPS analysis prevents increase of resistivity due to the chipped filler when the number of printed sheets is low per one job and in low-density printing, and toner spent in high-density printing, i.e., stably produces quality images regardless of the printing density.

Further, the filler preferably includes a substrate element in an amount not greater than 1.0% by atom when subjected to an XPS analysis. When greater than 1.0% by atom, a number of the substrates are exposed, the resistivity is likely to increase and toner spent is likely to occur. The filler preferably includes a substrate element in an amount not greater than 1.0% by atom even after a considerable number of images are produced.

In order to maintain Sn in an amount not less than 0.5% by atom when subjected to an XPS analysis on the surface of the carrier, an electroconductive filler having an electroconductive layer preferably having a thickness of from 0.1 to 0.6 μm, more preferably from 0.15 to 0.5 μm, and further more preferably from 0.2 to 0.4 μm is preferably used. Although the resin coated layer is chipped in low-density printing, a new $SnO_2$—P or $SnO_2$—W layer appears on the surface to maintain Sn in an amount not less than 0.5% by atom.

When less than 0.1 μm, the substrate is likely to be exposed when low-density printing is repeated, and a ratio of the filler substrate becomes larger than 1.0% by atom when subjected to an XPS analysis. Thus, the electroconductive layer of the filler is worn out and the filler substrate exposed, and the carrier is likely to increase in resistivity even before its core material is exposed. When not less than 0.1 μm, the filler substrate component is not or just slightly observed when subjected to an XPS analysis on the surface of the carrier even after low-density printing. The electroconductive layer remains and the substrate is scarcely exposed.

When greater than 0.6 μm, it is difficult to produce the electroconductive filler because an aggregate is likely to be formed.

The electroconductive filler is preferably formed of a substrate such as aluminum oxide, titanium dioxide, zinc oxide, silicon dioxide, barium sulfate and zirconium oxide; and an electroconductive layer overlying the substrate, such as $SnO_2$—P and $SnO_2$—W. Particulate electroconductive compounds such as $InO_2$ decreasing resistivity are not preferably included. Particularly, aluminum oxide, titanium dioxide and barium sulfate are preferably used as the substrate.

Further, the filler preferably has a particle diameter of from 50 to 1500 nm, and more preferably from 300 to 1000 nm. The filler having a specific particle diameter is easy to appear on the surface of the resin coated layer to form a partial low resistivity, has good abrasion resistance, and scrapes spent materials on the surface of the carrier with ease.

The XPS is measured under the following conditions.

Apparatus: A-Alpha from Thermo Fisher Scientific Inc.

Light source: A 1 (monochrometer)

Power: 72 W (12 kv, 6 mA)

Beam diameter: 400 μm

Pulse energy: (widescan) 200 eV, narrowscan) 50 eV

Energy Step: (widescan) 1.5 eV, narrowscan) 0.2 eV

Relative sensitivity coefficient: from Thermo Fisher Scientific Inc.

When $SnO_2$—P or $SnO_2$—W is used as the electroconductive layer without a particulate electroconductive compound, chipped layer adheres to deteriorate chargeability and charge quantity decreases as images are produced. In order to maintain chargeability, the reason is not clarified, but a silicone resin and a methacrylic ester or an acrylic ester resin included in the coated layer of a carrier as resin components prevent charge quantity from decreasing.

Further, the resin component in the coated layer preferably includes a crosslinked material obtained by hydrolyzing a copolymer including a structure having the following formula (1) to produce a silanol group and condensing the silanol group, and a crosslinked material obtained by condensing a copolymer including a structure having the following formula (1) and a silicone resin having a silanol group and/or a functional group capable of producing a silanol group by hydrolyzing. The resin component in the coated layer preferably includes the copolymer including a structure having the following formula (1) in an amount of from 3 to 90% by weight.

When X is greater than 80, X or Y is less than 10, the coated layer of the carrier is difficult to have repellency, hardness and flexibility.

Specific examples of the components in the formula (1) include those disclosed in Japanese published unexamined application No. JP-2011-197227-A.

In the present invention, resin components for forming the coated layer of the carrier includes the copolymer and a silicone resin. The silicone resin preferably has a silanol group and/or a functional group capable of producing a silanol group by hydrolyzing, e.g., anionic groups such as an alkoxy group and a halogen group bonded with a Si atom. The silicone resin having a silanol group and/or a functional group capable of producing a silanol group by hydrolyzing can polycondense directly with a crosslinked component of the copolymer or a crosslinked component changed to a silanol group. A silicone resin component included in the copolymer further improves toner spent.

Specific examples of the commercially available silicone resins having a silanol group and/or a functional group capable of producing a silanol group by hydrolyzing include, but are not limited to, KR251, KR271, KR272, KR282, KR252, KR255, KR152, KR155, KR211, KR216, and KR213 (from Shin-Etsu Chemical Co., Ltd.); and AY42-170, SR2510, SR2400, SR2406, SR2410, SR2405, and SR2411 (from Dow Corning Toray Co., Ltd.).

Among various silicone resins, methyl silicone resins are preferable because they are less adhesive to toner and their charge is less susceptible to environmental fluctuation.

(1)

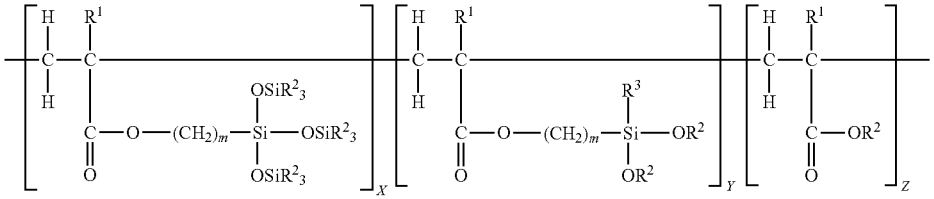

wherein $R^1$ represents a hydrogen atom or a methyl group, m represents an integer of 1 to 8, $R^2$ represents an alkyl group having 1 to 4 carbon atoms, $R^3$ represents an alkyl group having 1 to 8 carbon atoms or an alkoxy group having 1 to 4 carbon atoms, each of X and Y represents a molar ratio (%) between 10 to 40, Z represents a molar ratio (%) between 20 to 80, and X+Y+Z=100 is satisfied.

In the formula (1), a part having the following formula (2) is a methacrylic ester or an acrylic ester component.

(2)

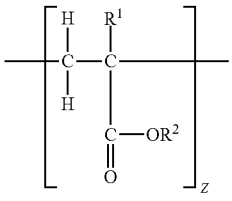

wherein $R^1$ represents a hydrogen atom or a methyl group, and $R^2$ represents an alkyl group having 1 to 4 carbon atoms.

It is preferable that Z is from 35 to 75 and 60<Y+Z<90, and more preferably 70<Y+Z<85.

The silicone resin preferably has a weight average molecular weight of 1,000 to 100,000, more preferably 1,000 to 30,000. When the weight average molecular weight is too large, the resulting resin layer may be not uniform because the coating liquid has too large a viscosity. Moreover, the hardened resin layer may have a low density. When the weight average molecular weight is too small, the hardened resin layer may be too brittle.

The content of the silicone resin is preferably 10 to 97 parts by weight, based on total weight of the copolymer and the silicone resin. When the content of the silicone resin is too small, the resulting resin layer may be adhesive to toner. When the content of the silicone resin is too large, the resulting resin layer may have poor toughness and may be easily abraded.

Compositions for forming the coated layer of the carrier include, a filler, preferably a copolymer including the structure having the formula (1), a silicone resin having a silanol group and/or a hydrolyzable functional group, a polymerization catalyst, a resin besides the silicone resin having a silanol group and/or a hydrolyzable functional group when necessary, and a solvent. In terms of preventing toner spent in high-density printing, a resin having high repellency is preferably used.

Specifically, the coated layer may be formed by condensing the silanol group while or after coating the particulate core material with the compositions for forming the coated layer. Specific examples of the method of condensing the silanol group while coating the particulate core material with the compositions include, but are not limited to, a method of coating the particulate core material with the compositions while applying heat or light thereto. Specific examples of the method of condensing the silanol group after coating the particulate core material with the compositions include, but are not limited to, a method of heating the compositions at 100 to 350° C. for hrs after coating the particulate core material therewith.

The core particle covered with the resin composition is heated at a temperature less than the Curie point of the core particle, preferably at 100 to 350° C., more preferably at 150 to 250° C., so that cross-linking reaction (i.e., condensation reaction) is accelerated.

When the heating temperature is too low, the cross-linking reaction may not proceed and the resulting layer may have poor strength.

When the heating temperature is too high, the copolymer may become carbonized and the resulting layer may be easily abraded.

Specific examples of resins besides the silicone resin having a silanol group and/or a hydrolyzable functional group include, but are not limited to, acrylic resins, amino resins, polyvinyl resins, polystyrene resins, halogenated olefin resins, polyester resins, polycarbonate resins, polyethylene resins, polyvinyl fluoride resins, polyvinylidene fluoride resins, poly(trifluoroethylene) resins, poly(hexafluoropropylene) resins, copolymer of vinylidene fluoride and vinyl fluoride, fluoroterpolymer (e.g., terpolymer of tetrafluoroethylene, vinylidene fluoride, and a non-fluoride monomer), and silicone resins having no silanol group and/or no hydrolyzable group. Two or more of these resins can be used in combination.

As the polymerization catalyst, titanium-based catalysts, tin-based catalysts, zirconium-based catalysts, or aluminum-based catalysts can be used. Among these catalysts, titanium-based catalysts are preferable. More specifically, titanium alkoxide catalysts and titanium chelate catalysts are preferable. The above catalysts effectively accelerate condensation reaction of silanol group derived from the crosslinked component in the formula (1) while keeping good catalytic ability. Specific examples of the titanium alkoxide catalysts include, but are not limited to, titanium diisopropoxy bis(ethylacetoacetate). Specific examples of the titanium chelate catalysts include, but are not limited to, titanium diisopropoxy bis(triethanolaminate).

In the present invention, the compositions for forming the coated layer preferably include a silane coupling agent stably dispersing the filler.

Specific examples of usable silane coupling agents include, but are not limited to, γ-(2-aminoethyl)aminopropyl trimethoxysilane, γ-(2-aminoethyl)aminopropylmethyl dimethoxysilane, γ-methacryloxypropyl trimethoxysilane, N-β-(N-vinylbenzylaminoethyl)-γ-aminopropyl trimethoxysilane hydrochloride, γ-glycidoxypropyl trimethoxysilane, γ-mercaptopropyl trimethoxysilane, methyl trimethoxysilane, methyl triethoxysilane, vinyl triacetoxysilane, γ-chloropropyl trimethoxysilane, hexamethyl disilazane, γ-anilinopropyl trimethoxysilane, vinyl trimethoxysilane, octadecyldimethyl[3-(trimethoxysilyl)propyl]ammonium chloride, γ-chloropropylmethyl dimethoxysilane, methyl trichlorosilane, dimethyl dichlorosilane, dimethyl chlorosilane, allyl triethoxysilane, 3-aminopropylmethyl diethoxysilane, 3-aminopropyl trimethoxysilane, dimethyl diethoxysilane, 1,3-divinyltetramethyl disilazane, and methacryloxyethyldimethyl(3-trimethoxysilylpropyl)ammonium chloride. Two or more of these materials can be used in combination.

Specific examples of commercially-available silane coupling agents include, but are not limited to, AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (from Dow Corning Toray Co., Ltd.).

The content of the silane coupling agent is preferably 0.1 to 10% by weight based on the silicone resin. When the content of the silane coupling agent is too small, adhesiveness between the silicone resin and the core particle or conductive particle may be poor. When the content of the silane coupling agent is too large, toner filming may occur in a long-term use.

The core particle of the carrier is a magnetic material. Specific preferred examples of suitable magnetic materials for the core particle include, but are not limited to, ferromagnetic materials (e.g., iron, cobalt), iron oxides (e.g., magnetite, hematite, ferrite), alloys, and resin particles in which magnetic materials are dispersed. Among these materials, Mn ferrite, Mn—Mg ferrite, and Mn—Mg—Sr ferrite are preferable because they are environmentally-friendly.

The core material preferably has a weight-average particle diameter of from 10 to 80 μm and a BET specific surface area of from 0.05 to 0.30 $m^3/g$.

A carrier coated with a resin preferably has a bulk density of from 1.8 to 2.4 $g/cm^3$. When less than 1.8 $g/cm^3$, carrier adherence tends to occur. When greater than 2.4 $g/cm^3$, the carrier receives more stirring stress in an image developer, resulting in larger variation of resistivity. The bulk density of a carrier is measured by dropping the carrier at a height of 25 mm from a funnel having an orifice diameter of 3 mm into a container having a capacity of 25 $cm^3$.

In the present invention, the weight-average particle diameter (Dw) of a carrier and a toner is calculated based on a particle diameter distribution (i.e., a relation between number frequency and particle diameter) of particles as follows:

$$Dw=\{1\Sigma(nD^3)\}\times\{\Sigma(nD^4)\}$$

wherein D represents a representative particle diameter (μm) of particles present in each channel and n represents the number of the particles present in each channel.

The channel represents a unit length that divides the measuring range of particle diameter into a measuring unit width. In this specification, the channel has a length of 2 μm.

The minimum particle diameter present in each channel is employed as the representative particle diameter.

In the present invention, the particle diameter distribution is measured by a Microtrac particle size analyzer (HRA9320-X100 from Honeywell International Inc.) under the following measurement conditions.

Particle diameter range: 100 to 8 μm
Channel width: 2 μm
Number of channels: 46
Refractive index: 2.42

The particle diameter of the filler is determined on a number-average particle diameter by randomly sampling 100 particles of a sample with an FE-SEM (S-800) from Hitachi, Ltd. at a magnification of 10000 times.

The thickness of the electroconductive layer of the filler is determined by deducting a number-average particle diameter of the filler substrate from the number-average particle diameter of the filler and reducing the difference to half.

The filler resistivity is a volume resistivity measured by a powder resistivity measuring system MCP-PD51 from DIAINSTRUMENTS CO., LTD. with a four-terminal & four-probe Loresta GP under the following conditions.

Sample: 1.0 g

Electrode gap: 3 mm

Sample radius: 10.0 mm

Load: 20 kN

The carrier of the present invention is mixed with a toner to be used as a two-component developer.

The toner comprises a binder resin (e.g., a thermoplastic resin), a colorant, a charge controlling agent, a release agent, fine particles, etc. The toner may be obtained by various manufacturing methods such as polymerization methods and granulation methods, and have either an irregular or spherical shape. The toner may be either magnetic or non-magnetic.

Specific examples of usable binder resins for the toner include, but are not limited to, styrene-based resins (e.g., homopolymers of styrene or styrene derivatives such as polystyrene and polyvinyl toluene; and styrene-based copolymers such as styrene-p-chlorostyrene copolymer, styrene-propylene copolymer, styrene-vinyltoluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic acid copolymer, styrene-maleate copolymer), acrylic resins (e.g., polymethyl methacrylate, polybutyl methacrylate), polyvinyl chloride, polyvinyl acetate, polyethylene, polypropylene, polyester, polyurethane, epoxy resin, polyvinyl butyral, polyacrylic acid resin, rosin, modified rosin, terpene resin, phenol resin, aliphatic or alicyclic hydrocarbon resin, aromatic petroleum resin, chlorinated paraffin, and paraffin wax. Two or more of these resins can be used in combination.

Among these resins, polyester resins are preferable because they can have lower viscosity when melted while keeping better storage stability than styrene-based or acrylic resins.

The polyester resin can be obtained from a polycondensing reaction between an alcohol and a carboxylic acid.

Specific examples of suitable alcohols include, but are not limited to, diols (e.g., polyethylene glycol, diethylene glycol, triethylene glycol, 1,2-propylene glycol, 1,3-propylene glycol, 1,4-propylene glycol, neopentyl glycol, 1,4-butenediol), etherified bisphenols (e.g., 1,4-bis(hydroxymethyl)cyclohexane, bisphenol A, hydrogenated bisphenol A, polyoxyethylenated bisphenol A, polyoxypropylenated bisphenol A), divalent alcohols in which the above compounds are substituted with a saturated or unsaturated hydrocarbon group having 3 to 22 carbon atoms, other divalent alcohols, and tri- or more valent alcohols (e.g., sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene).

Specific examples of suitable carboxylic acids include, but are not limited to, monocarboxylic acids (e.g., palmitic acid, stearic acid, oleic acid), maleic acid, fumaric acid, mesaconic acid, citraconic acid, terephthalic acid, cyclohexane dicarboxylic acid, succinic acid, adipic acid, sebacic acid, malonic acid, divalent organic acids in which the above compounds are substituted with a saturated or unsaturated hydrocarbon group having 3 to 22 carbon atoms, anhydrides and lower esters of the above compounds, dimer acids of linoleic acid, and tri- or more valent carboxylic acids (e.g., 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid enpol trimmer acid, and anhydrides of these compounds).

When a crystalline polyester resin is used together, the toner is fixable at low temperature and improve glossiness of images even at low temperature. The crystalline polyester resin transforms its crystal at a glass transition temperature, and quickly decreases melt viscosity from solid state to be fixable on recording media such as papers. The crystalline polyester resin preferably has a crystalline index, i.e., a ratio of a softening point to an endothermic maximum peak temperature measure by a differential scanning calorimeter (DSC), of from 0.6 to 1.5, and more preferably from 0.8 to 1.2. The content of the crystalline polyester resin is preferably from 1 to 35 parts by weight, and preferably from 1 to 25 parts by weight per 100 parts by weight of the polyester resin. When too much, toner filming over image bearers such as a photoreceptor tends to occur and storage stability of the toner deteriorates.

The epoxy resin can be obtained from polycondensing between bisphenol A and epichlorohydrin. Specific examples of commercially available epoxy resins include, but are not limited to, EPOMIK R362, R364, R365, R366, R367, and R369 (from Mitsui Chemicals, Inc.), EPOTOHTO YD-011, YD-012, YD-014, YD-904, and YD-017, (from Nippon Steel Chemical Co., Ltd.), and EPIKOTE 1002, 1004, and 1007 (from Shell Chemicals).

Specific examples of usable colorants include, but are not limited to, carbon black, lamp black, iron black, Ultramarine Blue, Nigrosine dyes, Aniline Blue, Phthalocyanine Blue, Hansa Yellow G, Rhodamine 6G Lake, Calco Oil Blue, Chrome Yellow, Quinacridone, Benzidine Yellow, Rose Bengal, triarylmethane dyes, monoazo and disazo dyes and pigments. Two or more of such colorants can be used in combination to obtain a desired color tone.

A transparent toner can be formed without a colorant.

Black toner may include a magnetic material to be used as a magnetic toner. Specific examples of usable magnetic materials include, but are not limited to, powders of ferromagnetic materials (e.g., iron, cobalt), magnetite, hematite, Li ferrite, Mn—Zn ferrite, Cu—Zn ferrite, Ni—Zn ferrite, and Ba ferrite.

The toner may include a charge controlling agent to improve frictional chargeability. Specific examples of usable charge controlling agents include, but are not limited to, metal complex salts of monoazo dyes, nitrohumic acid and salts thereof, metal complex of salicylic acid, naphthoic acid, and dicarboxylic acid with Co, Cr, Ce, etc., amino compounds, quaternary ammonium compounds, and organic dyes.

Preferably, the toners having colors other than black include a white or a transparent material such as a white metal salt of a salicylic acid derivative.

The toner may include a release agent. Specific examples of usable release agents include, but are not limited to, low-molecular-weight polypropylene, low-molecular-weight polyethylene, carnauba wax, microcrystalline wax, jojoba wax, rice wax, montan wax. Two or more of these release agents can be used in combination.

The toner may externally include a fluidizer. The toner having proper fluidity produces high quality images. For example, fine particles of hydrophobized metal oxides, lubricants, metal oxides, organic resins, and metal salts may be externally added to the toner. Specific examples of suitable fluidizers include, but are not limited to, lubricants such as fluorocarbon resins (e.g., polytetrafluoroethylene) and zinc stearate; abrasive agents such cerium oxide and silicon carbide; inorganic oxides such as $SiO_2$ and $TiO_2$, the surfaces of which may be hydrophobized; caking preventing agents; and the above compounds of which surfaces are treated. Among various compounds, hydrophobized silica is preferable as a fluidizer.

The toner preferably has a weight average particle diameter of 3.0 to 9.0 μm, and more preferably 3.0 to 6.0 μm. Particle diameter of the toner can be measured by COULTER MULTISIZER II (from Beckman Coulter, Inc.).

A ratio of the carrier to the toner in a two-component developer is preferably from 90/10 to 97/3.

The carrier may be used for a supplemental developer that is supplied to a developing device while a deteriorated developer is discharged therefrom. Because deteriorated carrier particles are replaced with fresh carrier particles included in the supplemental developer, toner particles are reliably charged and images are stably produced for an extended period of time.

The use of supplemental developer is effective when printing an image having a high area occupancy. When printing an image having a high area occupancy, carrier particles are deteriorated by adherence of toner particles while a large amount of supplemental carrier particles are supplied. Thus, the frequency of replacing deteriorated carrier particles with fresh carrier particles is increased and images are stably produced for an extended period of time.

The supplemental developer preferably includes a toner in an amount of 2 to 50 parts by weight, more preferably 5 to 12 parts by weight, based on 1 part by weight of the carrier. When the amount of toner is too small, toner particles may be excessively charged because an excessive amount of the carrier particles exist in a developing device. Because the excessively charged toner particles have poor developing power, the resulting image density may deteriorate. When the amount of toner is too large, the frequency of replacing deteriorated carrier particles with fresh carrier particles is reduced.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The image forming method of the present invention includes a process of forming an electrostatic latent image on an electrostatic latent image bearer, a process of developing the electrostatic latent image formed on the electrostatic latent image bearer with the two-component developer of the present invention to form a toner image, a process of transferring the toner image formed on the electrostatic latent image bearer onto a recording medium, and a process of fixing the toner transferred onto the recording medium. The process of forming a toner image preferably holds the two-component developer of the present invention on a developer bearer and develops a toner in the developer forming a magnetic brush on the electrostatic latent image bearer to form a toner image.

Figure 1:
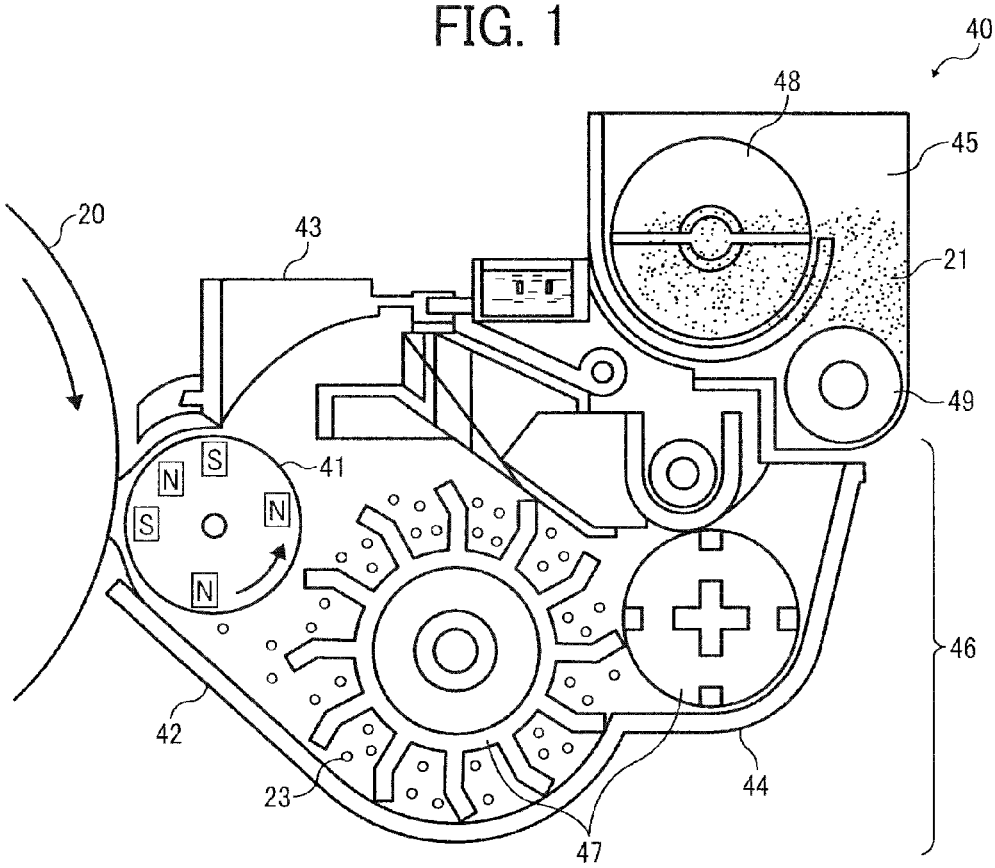
FIG. 1 is a schematic view illustrating an embodiment of image developer executing the image forming method of the present invention.

FIG. 1 is a cross-sectional view illustrating an image developer included in an image forming method and an image forming apparatus according to exemplary aspects of the invention.

A developing device 40 is provided facing a photoreceptor 20 serving as an image bearing member. The developing device 40 includes a developing sleeve 41 serving as a developer bearing member, a developer container 42, a doctor blade 43 serving as a regulation member, and a support casing 44.

The support casing 44 has an opening on a side facing the photoreceptor 20. A toner hopper 45 serving as a toner container that contains toner particles 21 is attached to the support casing 44. A developer containing part 46 contains a developer comprising the toner particles 21 and carrier particles 23. A developer agitator 47 agitates the toner particles 21 and carrier particles 23 to frictionally charge the toner particles 21.

A toner agitator 48 and a toner supplying mechanism 49 each rotated by riving means, not shown, are provided in the toner hopper 45.

The toner agitator 48 and the toner supplying mechanism 49 agitate and supply the toner particles 21 in the toner hopper 45 toward the developer containing part 46.

The developing sleeve 41 is provided within a space between the photoreceptor 20 and the toner hopper 45. The developing sleeve 41 is driven to rotate counterclockwise in FIG. 1 by a driving means, not shown. The developing sleeve 41 internally contains a magnet serving as a magnetic field generator. The relative position of the magnet to the developing device 40 remains unchanged.

The doctor blade 43 is integrally provided to the developer container 42 on the opposite side of the support casing 44. A constant gap is formed between the tip of the doctor blade 43 and the circumferential surface of the developing sleeve 41.

In a developing method according to exemplary aspects of the invention, the toner agitator 48 and the toner supplying mechanism 49 feed the toner particles 21 from the toner hopper 45 to the developer containing part 46. The developer agitator 47 agitates the toner particles 21 and the carrier particles 23 to frictionally charge the toner particles 21. The developing sleeve 41 bears the charged toner particles 21 and conveys them to a position where faces an outer peripheral surface of the photoreceptor 20 by rotation. The toner particles 21 then electrostatically bind to an electrostatic latent image formed on the photoreceptor 20. Thus, a toner image is formed on the photoreceptor 20.

Figure 2:
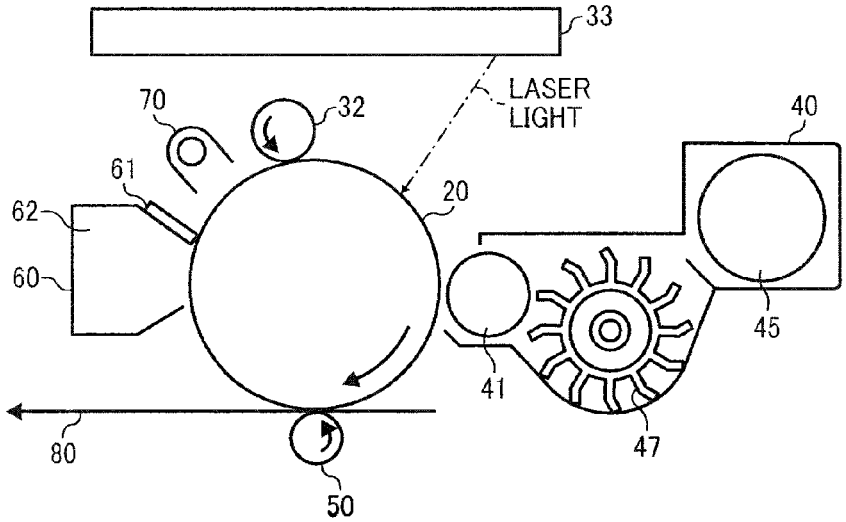
FIG. 2 is a schematic view illustrating an embodiment of image forming apparatus executing the image forming method of the present invention.

FIG. 2 is a schematic view illustrating an embodiment of image forming apparatus executing the image forming method of the present invention.

Around a photoreceptor 20, a charging member 32, an irradiator 33, a developing device 40, a transfer member 50, a cleaning device 60, and a neutralization lamp 70 are provided. A surface of the charging member 32 forms a gap of about 0.2 mm with a surface of the photoreceptor 20. When an electric filed in which an alternating current component is overlapped with a direct current component is applied to the charging member 32 from a voltage applying mechanism, not shown, the photoreceptor 20 can be uniformly charged.

This image forming apparatus employs a negative-positive image forming process. The photoreceptor 20 having an organic photoconductive layer is neutralized by the neutralization lamp 70, and then negatively charged by the charging member 32. The charged photoreceptor 20 is irradiated with a laser light beam emitted from the irradiator 33 to form an electrostatic latent image thereon. In this embodiment, the absolute value of the potential of the irradiated portion is lower than that of the non-irradiated portion.

The laser light beam is emitted from a semiconductive laser. A polygon mirror that is a polygonal column rotating at a high speed scans the surface of the photoreceptor 20 with the laser light beam in the axial direction. The electrostatic latent image thus formed is then developed into a toner image with a developer supplied to a developing sleeve 41 in the developing device 40. When developing electrostatic latent image, a developing bias that is a predetermined voltage or that overlapped with an alternating current voltage is applied from a voltage applying mechanism, not shown, to between the developing sleeve 41 and the irradiated and non-irradiated portions on the photoreceptor 20.

On the other hand, a transfer medium 80 (e.g., paper, an intermediate transfer medium) is fed from a paper feed mechanism, not shown. A pair of registration rollers, not shown, feeds the transfer medium 80 to a gap between the photoreceptor 20 and the transfer member 50 in synchronization with an entry of the toner image to the gap so that the toner image is transferred onto the transfer medium 80. When transferring toner image, a transfer bias that is a voltage having the opposite polarity to the toner charge is applied to the transfer member 50. Thereafter, the transfer medium 80 separates from the photoreceptor 20.

Toner particles remaining on the photoreceptor 20 are removed by a cleaning blade 61 and collected in a toner collection chamber 62 in the cleaning device 60.

The collected toner particles may be refed to the developing device 40 by a recycle mechanism, not shown.

The image forming apparatus may include multiple developing devices. In this case, multiple toner images are sequentially transferred onto a transfer medium to form a composite toner image, and the composite toner image is finally fixed on the transfer medium. The image forming apparatus may further include and an intermediate transfer member. In this case, multiple toner images are transferred onto the intermediate transfer member to form a composite toner image, and the composite toner image is then transferred onto and fixed on a transfer medium.

Figure 3:
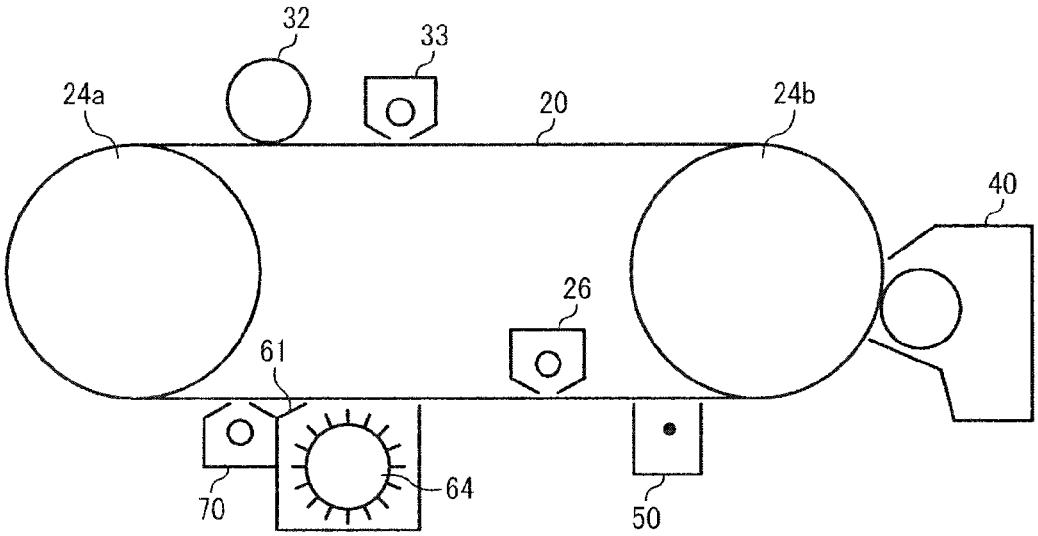
FIG. 3 is a schematic view illustrating another embodiment of image forming apparatus executing the image forming method of the present invention.

FIG. 3 is a schematic view illustrating another embodiment of image forming apparatus executing the image forming method of the present invention. A photoreceptor 20 having a conductive substrate and a photosensitive layer is driven by driving rollers 24*a* and 24*b*. The photoreceptor 20 is repeatedly subjected to processes of charging by a charging member 32, irradiation by an irradiator, development by a developing device 40, transfer by a transfer member 50, pre-cleaning irradiation by a light source 26, cleaning by a cleaning brush 64 and a cleaning blade 61, and neutralization by a neutralization lamp 70. In the pre-cleaning irradiation process, light is emitted from the back side of the photoreceptor 20. Therefore, in this embodiment, the conductive substrate is translucent.

Figure 4:
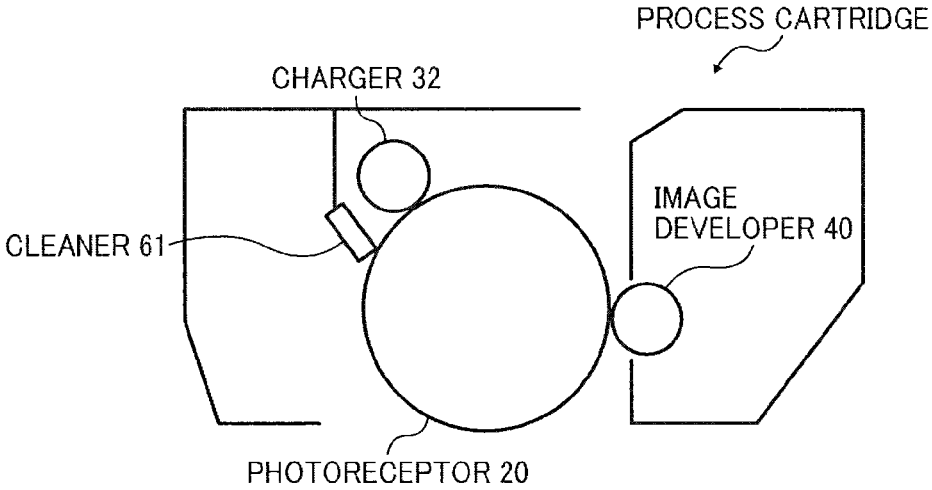
FIG. 4 is a schematic view illustrating an embodiment of process cartridge of the present invention.

FIG. 4 is a schematic view illustrating an embodiment of process cartridge of the present invention. The process cartridge integrally supports a photoreceptor 20, *a* charging member 32, *a* developing device 40, and a cleaning blade 61. The process cartridge is detachably attachable to image forming apparatuses.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Filler Preparation Example 1

A suspension was prepared by dispersing 100 g of aluminum oxide (AKP-30 from Sumitomo Chemical Co., Ltd.) in 1 liter of water, followed by heating at 70° C. A solution in which 150 g of tin(IV) chloride and 4.5 g of phosphorus pentoxide were dissolved in 1.5 liter of 2N hydrochloric acid and a 12% ammonia water were dropped in the suspension over a period of 3 hours so that pH of the suspension becomes 7 to 8. The suspension was then filtered and washed to obtain a cake. The cake was dried at 110° C. The resulting dried powder was treated at 500° C. for 1 hour under nitrogen gas flow. Thus, a filler 1 having a number-average particle diameter of 600 nm, volume resistivity of 3 Ω·cm, and an electroconductive layer thickness of 0.37 μm was prepared.

Filler Preparation Example 2

A suspension was prepared by dispersing 100 g of aluminum oxide (AKP-30 from Sumitomo Chemical Co., Ltd.) in 1 liter of water, followed by heating at 70° C. A solution in which 125 g of tin(IV) chloride and 3.7 g of phosphorus pentoxide were dissolved in 1 liter of 2N hydrochloric acid and a 12% ammonia water were dropped in the suspension over a period of 2.5 hours so that pH of the suspension becomes 7 to 8. The suspension was then filtered and washed to obtain a cake. The cake was dried at 110° C. The resulting dried powder was treated at 500° C. for 1 hour under nitrogen gas flow. Thus, a filler 2 having a number-average particle diameter of 500 nm, volume resistivity of 12 Ω·cm, and an electroconductive layer thickness of 0.27 μm was prepared.

Filler Preparation Example 3

A suspension was prepared by dispersing 100 g of aluminum oxide (AKP-30 from Sumitomo Chemical Co., Ltd.) in 1 liter of water, followed by heating at 70° C. A solution in which 100 g of tin(IV) chloride and 3 g of phosphorus pentoxide were dissolved in 1 liter of 2N hydrochloric acid and a 12% ammonia water were dropped in the suspension over a period of 2 hours so that pH of the suspension becomes 7 to 8. The suspension was then filtered and washed to obtain a cake. The cake was dried at 110° C. The resulting dried powder was treated at 500° C. for 1 hour under nitrogen gas flow. Thus, a filler 3 having a number-average particle diameter of 400 nm, volume resistivity of 50 Ω·cm, and an electroconductive layer thickness of 0.17 μm was prepared.

Filler Preparation Example 4

A suspension was prepared by dispersing 100 g of aluminum oxide (AKP-30 from Sumitomo Chemical Co., Ltd.) in 1 liter of water, followed by heating at 70° C. A solution in which 11.6 g of tin(IV) chloride were dissolved in 1 liter of 2N hydrochloric acid and a 12% ammonia water were dropped in the suspension over a period of 40 minutes so that pH of the suspension becomes 7 to 8. Further, a solution in which 36.7 g of indium chloride and 5.4 g of tin(IV) chloride were dissolved in 450 ml of 2N hydrochloric acid and a 12% ammonia water were dropped in the suspension over a period of 1 hour so that pH of the suspension becomes 7 to 8. The suspension was then filtered and washed to obtain a cake. The cake was dried at 110° C. The resulting dried powder was treated at 500° C. for 1 hour under nitrogen gas flow. Thus, a filler 4 having a number-average particle diameter of 300 nm, volume resistivity of 4 Ω·cm, and an electroconductive layer thickness of 0.08 μm was prepared.

Filler Preparation Example 5

A suspension was prepared by dispersing 100 g of a rutile-type titanium oxide (KR-310 from Titan Kogyo, Ltd.) in 1 liter of water, followed by heating at 70° C. A solution in which 150 g of tin(IV) chloride and 4.2 g of phosphorus pentoxide were dissolved in 1 liter of 2N hydrochloric acid and a 12% ammonia water were dropped in the suspension over a period of 3 hours so that pH of the suspension becomes 7 to 8. The suspension was then filtered and washed to obtain a cake. The cake was dried at 110° C. The resulting dried powder was treated at 500° C. for 1 hour under nitrogen gas flow. Thus, a filler 5 having a number-average particle diameter of 650 nm, volume resistivity of 10 Ω·cm, and an electroconductive layer thickness of 0.16 μm was prepared.

Filler Preparation Example 6

A suspension was prepared by dispersing 100 g of a barium sulfate (SS-50 from SAKAI CHEMICAL INDUSTRY CO., LTD.) in 1 liter of water, followed by heating at 70° C. A solution in which 100 g of tin(IV) chloride and 3 g of phosphorus pentoxide were dissolved in 1 liter of 2N hydrochloric acid and a 12% ammonia water were dropped in the suspension over a period of 3 hours so that pH of the suspension becomes 7 to 8. The suspension was then filtered and washed to obtain a cake. The cake was dried at 110° C. The resulting dried powder was treated at 500° C. for 1 hour under nitrogen gas flow. Thus, a filler 6 having a number-average particle diameter of 300 nm, volume resistivity of 56 Ω·cm, and an electroconductive layer thickness of 0.35 μm was prepared.

Core Material Preparation Example 1

A mixture of $MnCO_3$, $Mg(OH)_2$, $Fe_2O_3$ and $SrCO_3$ were pre-burnt at 900° C. for 3 hours in the atmosphere using a heating oven, followed by cooling and pulverization to prepare a powder having a diameter about 7 μm.

Water and a dispersant in an amount of 1% by weight were added to the powder to prepare a slurry, and the slurry was fed to a sprat dryer to prepare a granulated material having an average particle diameter of 40 μm.

The granulated material was placed in a firing furnace and burnt at 1180° C. for 4 hrs under a nitrogen atmosphere. The burnt material was pulverized by a pulverizer and classified with a sieve to prepare a spherical particulate ferrite having a volume-average particle diameter about 35 μm, SF-1 of 135, SF-2 of 122 and Ra of 0.63 μm.

Core Material Preparation Example 2

A mixture of $MnCO_3$, $Mg(OH)_2$ and $Fe_2O_3$ were pre-burnt at 900° C. for 3 hours in the atmosphere using a heating oven, followed by cooling and pulverization to prepare a powder having a diameter about 7 μm.

Water and a dispersant in an amount of 1% by weight were added to the powder to prepare a slurry, and the slurry was fed to a sprat dryer to prepare a granulated material having an average particle diameter of 40 μm.

The granulated material was placed in a firing furnace and burnt at 1250° C. for 5 hrs under a nitrogen atmosphere. The burnt material was pulverized by a pulverizer and classified with a sieve to prepare a spherical particulate ferrite having a volume-average particle diameter about 35 μm, SF-1 of 140, SF-2 of 145 and Ra of 0.7 μm. The spherical particulate ferrite includes $MnCO_3$, $Mg(OH)_2$ and $Fe_2O_3$ in an amount of 46.2%, 0.7% and 53% by mol, respectively.

Resin Synthesis Example 1

A flask equipped with a stirrer was charged with 300 g of toluene and heated to 90° C. under nitrogen gas flow. A mixture of 84.4 g (i.e., 200 mmol) of 3-methacryloxypropyl tris(trimethylsiloxy)silane represented by $CH_2{=}CMe\text{-}COO{-}C_3H_6{-}Si(OSiMe_3)_3$ (Me: methyl group) (SILAPLANE™-0701T from Chisso Corporation), 39 g (i.e., 150 mmol) of 3-methacryloxypropyl methyldiethoxysilane, 65.0 g (i.e., 650 mmol) of methyl methacrylate, and 0.58 g (i.e., 3 mmol) of 2,2'-azobis-2-methylbutylonitrile was dropped in the flask over a period of 1 hour.

Further, a solution of 6 g (i.e., 0.3 mmol) of 2,2-azobis-2-methylbutylonitrole dissolved in 15 g of toluene was added to the flask. (The total amount of 2,2-azobis-2-methylbutylonitrole was 0.64 g, i.e., 3.3 mmol.) The mixture was then agitated for 3 hours at 90 to 100° C. to be subjected to radical polymerization. Thus, a resin 1 that is a methacrylic copolymer was prepared.

The resin 1 had a weight average molecular weight of 33,000. The resin 1 was diluted with toluene so that the diluted solution had 25% by weight of nonvolatile contents. The diluted toluene solution of the resin 1 had a viscosity of 8.8 $mm^2/s$ and a specific weight of 0.91.

Resin Synthesis Example 2

The procedure for preparing the resin 1 was repeated except for replacing the 39 g (i.e., 150 mmol) of 3-methacryloxypropyl methyldiethoxysilane with 37.2 g (i.e., 150 mmol) of 3-methacryloxypropyl trimethoxysilane. Thus, a resin 2 that is a methacrylic copolymer was prepared.

The resin 2 had a weight average molecular weight of 34,000. The resin 2 was diluted with toluene so that the diluted solution had 25% by weight of nonvolatile contents.

The diluted toluene solution of the resin 2 had a viscosity of 8.7 $mm^2/s$ and a specific weight of 0.91.

Carrier Preparation Example 1

Two hundred and ten (210) parts of methyl silicone resin (silicone resin having a silanol group and/or a hydrolyzable functional group) formed from a di- or trifunctional monomer having a weight-average molecular weight of 15,000 and a solid content of 25%, 7 parts of the resin prepared in Resin Synthesis Example 1, which is diluted by 25% by weight, 48 parts of filler 1, 9 parts of TC-750 from Matsumoto Fine Chemical Co., Ltd. that is titanium diisopropoxybis(ethylacetoacetate) as a catalyst, and 5 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier A.

Carrier Preparation Example 2

One hundred and fifty-six (156) parts of methyl silicone resin (silicone resin having a silanol group and/or a hydrolyzable functional group) formed from a di- or trifunctional monomer having a weight-average molecular weight of 15,000 and a solid content of 25%, 32 parts of the resin prepared in Resin Synthesis Example 1, which is diluted by 25% by weight, 20 parts of filler 1, 9 parts of TC-750 from Matsumoto Fine Chemical Co., Ltd. that is titanium diisopropoxybis(ethylacetoacetate) as a catalyst, and 5 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier B.

Carrier Preparation Example 3

One hundred and seventy-two (172) parts of methyl silicone resin (silicone resin having a silanol group and/or a hydrolyzable functional group) formed from a di- or trifunctional monomer having a weight-average molecular weight of 15,000 and a solid content of 25%, 16 parts of the resin prepared in Resin Synthesis Example 1, which is diluted by 25% by weight, 150 parts of filler 1, 9 parts of TC-750 from Matsumoto Fine Chemical Co., Ltd. that is titanium diisopropoxybis(ethylacetoacetate) as a catalyst, and 5 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier C.

Carrier Preparation Example 4

Sixty seven (67) parts of methyl silicone resin (silicone resin having a silanol group and/or a hydrolyzable functional group) formed from a di- or trifunctional monomer having a weight-average molecular weight of 15,000 and a solid content of 25%, 67 parts of the resin prepared in Resin Synthesis Example 2, which is diluted by 25% by weight, 74 parts of filler 1, 6 parts of TC-750 from Matsumoto Fine Chemical Co., Ltd. that is titanium diisopropoxybis(ethylacetoacetate) as a catalyst, and 4 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier D.

Carrier Preparation Example 5

Forty (40) parts of methyl silicone resin (silicone resin having a silanol group and/or a hydrolyzable functional group) formed from a di- or trifunctional monomer having a weight-average molecular weight of 15,000 and a solid content of 25%, 10 parts of the resin prepared in Resin Synthesis Example 1, which is diluted by 25% by weight, 31 parts of filler 1, 3 parts of TC-750 from Matsumoto Fine Chemical Co., Ltd. that is titanium diisopropoxybis(ethylacetoacetate) as a catalyst, and 1 pars of a silane coupling agent S116020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier E.

Carrier Preparation Example 6

Ten (10) parts of methyl silicone resin (silicone resin having a silanol group and/or a hydrolyzable functional group) formed from a di- or trifunctional monomer having a weight-average molecular weight of 15,000 and a solid content of 25%, 90 parts of the resin prepared in Resin Synthesis Example 1, which is diluted by 25% by weight, 31 parts of filler 1, 3 parts of TC-750 from Matsumoto Fine Chemical Co., Ltd. that is titanium diisopropoxybis(ethylacetoacetate) as a catalyst, and 1 pars of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier F.

Carrier Preparation Example 7

Sixty seven (67) parts of methyl silicone resin (silicone resin having a silanol group and/or a hydrolyzable functional group) formed from a di- or trifunctional monomer having a weight-average molecular weight of 15,000 and a solid content of 25%, 67 parts of the resin prepared in Resin Synthesis Example 1, which is diluted by 25% by weight, 74 parts of filler 2, 6 parts of TC-750 from Matsumoto Fine Chemical Co., Ltd. that is titanium diisopropoxybis(ethylacetoacetate) as a catalyst, and 4 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier G.

Carrier Preparation Example 8

Eighty (80) parts of methyl silicone resin (silicone resin having a silanol group and/or a hydrolyzable functional group) formed from a di- or trifunctional monomer having a weight-average molecular weight of 15,000 and a solid content of 25%, 20 parts of the resin prepared in Resin Synthesis Example 1, which is diluted by 25% by weight, 31 parts of filler 2, 5 parts of TC-750 from Matsumoto Fine Chemical Co., Ltd. that is titanium diisopropoxybis(ethylacetoacetate) as a catalyst, and 3 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 2 using a fluidized-bed coater while the fluid tank had an inner temperature of 70° C., and dried to prepare a carrier. The carrier was burnt in an electric oven at 180° C. for 2 hrs to prepare a carrier H.

Carrier Preparation Example 9

Sixty seven (67) parts of methyl silicone resin (silicone resin having a silanol group and/or a hydrolyzable functional group) formed from a di- or trifunctional monomer having a weight-average molecular weight of 15,000 and a solid content of 25%, 67 parts of the resin prepared in Resin Synthesis Example 1, which is diluted by 25% by weight, 74 parts of filler 3, 6 parts of TC-750 from Matsumoto Fine Chemical Co., Ltd. that is titanium diisopropoxybis(ethylacetoacetate) as a catalyst, and 4 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 2 using a fluidized-bed coater while the fluid tank had an inner temperature of 70° C., and dried to prepare a carrier. The carrier was burnt in an electric oven at 180° C. for 2 hrs to prepare a carrier I.

Carrier Preparation Example 10

Sixty seven (67) parts of methyl silicone resin (silicone resin having a silanol group and/or a hydrolyzable functional group) formed from a di- or trifunctional monomer having a weight-average molecular weight of 15,000 and a solid content of 25%, 67 parts of the resin prepared in Resin Synthesis Example 1, which is diluted by 25% by weight, 74 parts of filler 4, 6 parts of TC-750 from Matsumoto Fine Chemical Co., Ltd. that is titanium diisopropoxybis(ethylacetoacetate) as a catalyst, and 4 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 2 using a fluidized-bed coater while the fluid tank had an inner temperature of 70° C., and dried to prepare a carrier. The carrier was burnt in an electric oven at 180° C. for 2 hrs to prepare a carrier J.

Carrier Preparation Example 11

Sixty seven (67) parts of methyl silicone resin (silicone resin having a silanol group and/or a hydrolyzable functional group) formed from a di- or trifunctional monomer having a weight-average molecular weight of 15,000 and a solid content of 25%, 67 parts of the resin prepared in Resin Synthesis Example 1, which is diluted by 25% by weight, 74 parts of filler 5, 6 parts of TC-750 from Matsumoto Fine Chemical Co., Ltd. that is titanium diisopropoxybis(ethylacetoacetate) as a catalyst, and 4 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 2 using a fluidized-bed coater while the fluid tank had an inner temperature of 70° C., and dried to prepare a carrier. The carrier was burnt in an electric oven at 180° C. for 2 hrs to prepare a carrier K.

Carrier Preparation Comparative Example 1

Eighty (80) parts of methyl silicone resin (silicone resin having a silanol group and/or a hydrolyzable functional group) formed from a di- or trifunctional monomer having a weight-average molecular weight of 15,000 and a solid content of 25%, 20 parts of the resin prepared in Resin Synthesis Example 1, which is diluted by 25% by weight, 31 parts of filler 4, 5 parts of TC-750 from Matsumoto Fine Chemical Co., Ltd. that is titanium diisopropoxybis(ethylacetoacetate) as a catalyst, and 3 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier L.

Carrier Preparation Comparative Example 2

Sixty seven (67) parts of methyl silicone resin (silicone resin having a silanol group and/or a hydrolyzable functional group) formed from a di- or trifunctional monomer having a weight-average molecular weight of 15,000 and a solid content of 25%, 67 parts of the resin prepared in Resin Synthesis Example 1, which is diluted by 25% by weight, 74 parts of filler 4, 6 parts of TC-750 from Matsumoto Fine Chemical Co., Ltd. that is titanium diisopropoxybis(ethylacetoacetate) as a catalyst, and 4 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier M.

Carrier Preparation Comparative Example 3

One hundred and eighty (180) parts of methyl silicone resin (silicone resin having a silanol group and/or a hydrolyzable functional group) formed from a di- or trifunctional monomer having a weight-average molecular weight of 15,000 and a solid content of 25%, 8 parts of the resin prepared in Resin Synthesis Example 1, which is diluted by 25% by weight, 165 parts of filler 1, 9 parts of TC-750 from Matsumoto Fine Chemical Co., Ltd. that is titanium diisopropoxybis(ethylacetoacetate) as a catalyst, and 5 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier N.

Carrier Preparation Comparative Example 4

Eighteen (18) parts of methyl silicone resin (silicone resin having a silanol group and/or a hydrolyzable functional group) formed from a di- or trifunctional monomer having a weight-average molecular weight of 15,000 and a solid content of 25%, 74 parts of filler 2, 6 parts of TC-750 from Matsumoto Fine Chemical Co., Ltd. that is titanium diisopropoxybis(ethylacetoacetate) as a catalyst, and 4 parts of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier O.

Carrier Preparation Comparative Example 5

One hundred and thirty-four (134) parts of methyl silicone resin (silicone resin having a silanol group and/or a hydrolyzable functional group) formed from a di- or trifunctional monomer having a weight-average molecular weight of 15,000 and a solid content of 25%, 8 parts of the resin prepared in Resin Synthesis Example 1, which is diluted by 25% by weight, 4 parts of filler 1, 2 parts of TC-750 from Matsumoto Fine Chemical Co., Ltd. that is titanium diisopropoxybis(ethylacetoacetate) as a catalyst, and 1 part of a silane coupling agent SH6020 from Dow Corning Toray Silicone Co., Ltd. were diluted in toluene to prepare a resin solution including a solid content of 10% by weight. The resin solution was coated on 1000 parts of the core material prepared in Core Material Preparation Example 1 using a fluidized-bed coater while the fluid tank had an inner temperature of 70° C., and dried to prepare a carrier. The carrier was burnt in an electric oven at 180° C. for 2 hrs to prepare a carrier P.

<Preparation of Developer>

Nine hundred and thirty (930) parts of each of carriers A to P and 70 parts of a toner for a marketed digital full-color printer RICOH Pro C901 from Ricoh Company, Ltd. were stirred by a tubular mixer at 81 rpm for 5 min to prepare a developer. A supplemental developer including the carrier in an amount of 10% by weight was prepared.

<Image Evaluation Method>

The developer and the supplemental developer were set in a marketed digital full-color printer RICOH Pro C901 from Ricoh Company, Ltd., 100,000 images of a letter (2 mm×2 mm) chart having an image area of 1% were produced at one sheet/one job, and 100,000 solid images having an image area of 100% were produced at 1000 sheets/one job.

<Resistivity Variation>

Figure 5:
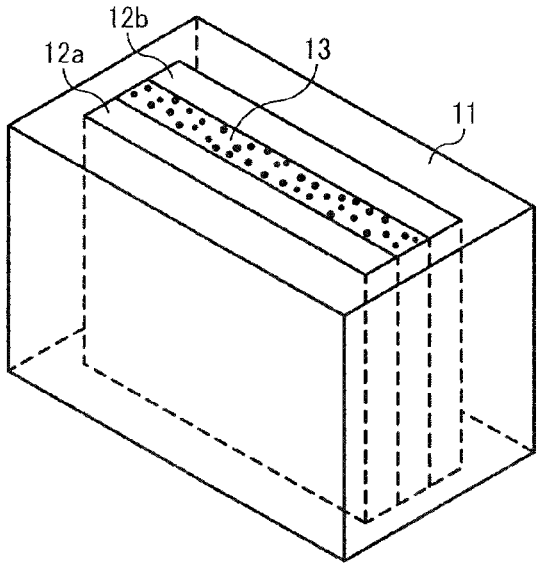
FIG. 5 is a perspective view illustrating a resistivity measuring cell used for measuring electric resistivity of a carrier.
Figure 6:
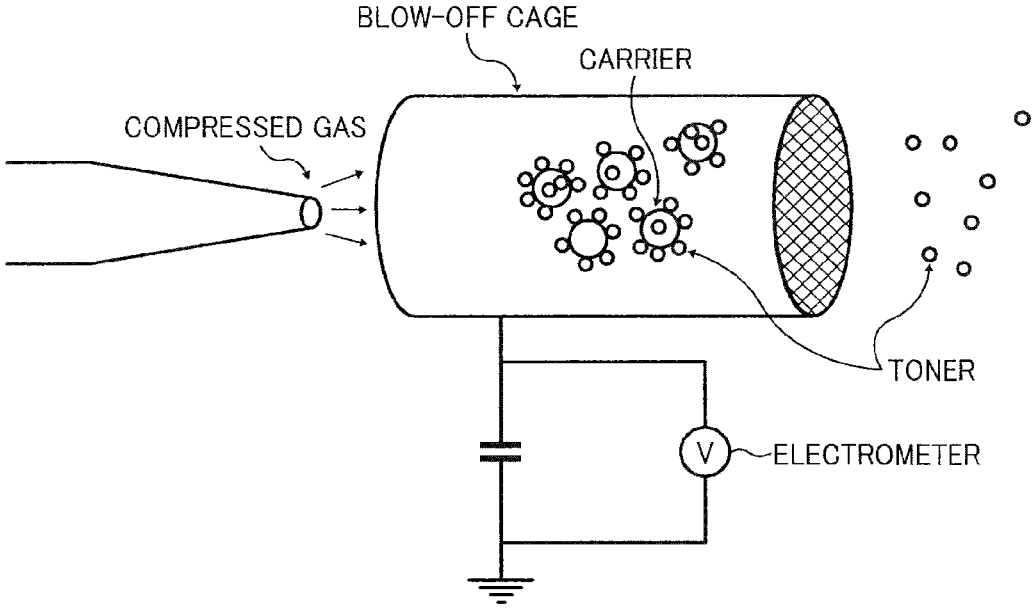
FIG. 6 is a schematic view illustrating a method of measuring a charge quantity of a developer in the present invention.

The toner was separated and removed from the developer using the apparatus in FIG. 6 with a 795 mesh to leave the carrier alone, and the resistivities thereof before and after the images were produced were measured using the apparatus in FIG. 5. The difference thereof was Δ Log R.

The measuring cell comprised of a fluorocarbon-resin container 11, in which electrodes 12*a* and 12*b* each having a surface area of 2.5 cm×4 cm are facing at a distance of 0.2 cm, is filled with the carrier 13. The cell filled with the carrier is tapped from a height of 1 cm for 10 times at a tapping speed of 30 times/min. Thereafter, a direct current voltage of 1,000 V is applied to between the electrodes 1*a* and 1*b* for 30 seconds to measure a resistance r (Ω) by a high resistance meter 4329A (from Hewlett-Packard Japan, Ltd.).

Δ Log R≤0.5: Excellent 0.5<Δ Log R≤1: Good

1<Δ Log R≤2: Acceptable

2<Δ Log R: Unusable

<Spent Toner Amount>

Toner components adhered to the carrier were extracted with methyl ethyl ketone before and after the running test. The difference between the weight of the extracted toner components before the running test and that after the running test was graded into the following four levels.

Not less than 0 and less than 0.03%
by weight based on carrier: Excellent

Not less than 0.03% and less than 0.07%
by weight based on carrier: Good

Not less than 0.07% and less than 0.15%
by weight based on carrier: Acceptable

Not less than 0.15% by weight based on carrier: Unusable

The results are shown in Tables 1-1 and 1-2.

TABLE 1-1

| | Sn content (% by atom) | Sn/Si | Substrate Element detection amount (% by atom) | Resin ratio to core material (%) |
|---|---|---|---|---|
| Example 1 | 1.3 | 0.062 | 0 | 4.84 |
| Example 2 | 0.54 | 0.03 | 0 | 4.26 |
| Example 3 | 3.8 | 0.19 | 0 | 4.26 |
| Example 4 | 2 | 0.12 | 0 | 3.08 |
| Example 5 | 1.13 | 0.061 | 0 | 1.1 |
| Example 6 | 1.13 | 0.081 | 0 | 1.1 |
| Example 7 | 1.5 | 0.07 | 0 | 3.08 |
| Example 8 | 0.79 | 0.04 | 0 | 2.3 |
| Example 9 | 1 | 0.06 | 0.2 | 3.08 |
| Example 10 | 1.8 | 0.108 | 0 | 3.08 |
| Example 11 | 0.8 | 0.048 | 0.5 | 3.08 |
| Comparative Example 1 | 0.3 | 0.016 | 1.3 | 2.3 |
| Comparative Example 2 | 0.48 | 0.029 | 1.3 | 3.08 |
| Comparative Example 3 | 4.2 | 0.21 | 0 | 4.26 |
| Comparative Example 4 | 1.5 | 0.07 | 0 | 3.08 |
| Comparative Example 5 | 0.4 | 0.024 | 0 | 0.8 |

TABLE 1-2

| | Resistivity variation after 100,000 (1% one sheet/one job) | Resistivity variation after 100,000 (100% 1000 sheets/one job) | Spent toner amount after 100,000 (100% 1000 sheets/one job) |
|---|---|---|---|
| Example 1 | Excellent | Excellent | Excellent |
| Example 2 | Excellent | Excellent | Excellent |
| Example 3 | Excellent | Good | Good |
| Example 4 | Excellent | Good | Good |
| Example 5 | Excellent | Excellent | Excellent |
| Example 6 | Excellent | Excellent | Excellent |
| Example 7 | Excellent | Excellent | Excellent |
| Example 8 | Excellent | Excellent | Excellent |
| Example 9 | Excellent | Excellent | Excellent |
| Example 10 | Excellent | Excellent | Excellent |
| Example 11 | Excellent | Excellent | Excellent |
| Comparative Example 1 | Acceptable | Excellent | Excellent |
| Comparative Example 2 | Acceptable | Excellent | Excellent |
| Comparative Example 3 | Excellent | Acceptable | Unusable |
| Comparative Example 4 | Excellent | Excellent | Good |
| Comparative Example 5 | Unusable | Good | Excellent |

The developers using the carriers in Examples 1 to 11 had low resistivity variations after producing 100,000 images of a letter chart having an image area of 1% at one sheet/one job, and 100,000 solid images having an image area of 100% at 1000 sheets/one job, and low toner spent amount and low variation of images.

The developers using the carriers in Comparative Examples 1 to 2 had large resistivity variations after producing 100,000 images of a letter chart having an image area of 1% at one sheet/one job. The developer using the carrier in Comparative Example 3 had large resistivity variation after producing 100,000 solid images having an image area of 100% at 1000 sheets/one job, and large toner spent amount. The developer using the carrier in comparative Example 4 had large deterioration of charge quantity of the toner, resulting in background fouling, toner scattering in the apparatus and increase of image density. The developer using the carrier in Comparative Example 5 had large resistivity variations after producing 100,000 images of a letter chart having an image area of 1% at one sheet/one job. The coated layer was worn out and the core material was exposed when observed by a SEM.

Having now fully described the invention, it will be apparent to one of ordinary skill in the art that many changes and modifications can be made thereto without departing from the spirit and scope of the invention as set forth therein.

What is claimed is:

1. A carrier for developing electrostatic latent image, comprising:

a particulate magnetic core material; and a coated layer covering the surface of the particulate magnetic core material, wherein the coated layer comprises a resin comprising a silicone resin and a methacrylic ester or an acrylic ester resin, and a filler comprising:

a substrate selected from the group consisting of aluminum oxide, titanium dioxide, zinc oxide, silicon dioxide, barium sulfate and zirconium oxide; and an electroconductive layer comprising tin dioxide ($SnO_2$), overlying the substrate, and wherein the carrier comprises tin (Sn) in an amount not less than 0.5% by atom and has a ratio (Sn/Si) of tin (Sn) to silicon (Si) of from 0.03 to 0.2 when subjected to an XPS analysis.

2. The carrier of claim 1, wherein the carrier comprises an element of the substrate of the filler in an amount not greater than 1.0% by atom.

3. The carrier of claim 1, wherein the resin in the coated layer comprises a crosslinked material obtained by hydrolyzing a copolymer including a structure having the following formula (1) to produce a silanol group and condensing the silanol group:

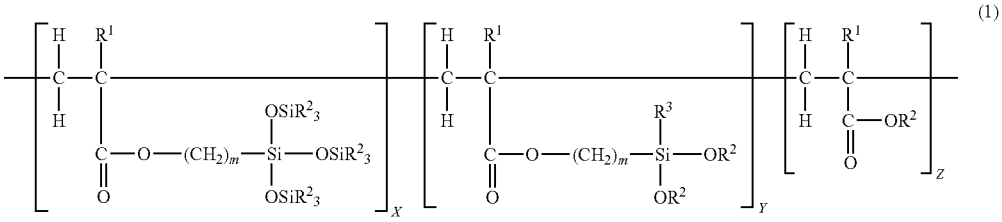

(1)

wherein $R^1$ represents a hydrogen atom or a methyl group, m represents an integer of 1 to 8, $R^2$ represents an alkyl group having 1 to 4 carbon atoms, $R^3$ represents an alkyl group having 1 to 8 carbon atoms or an alkoxy group having 1 to 4 carbon atoms, each of X and Y represents a molar ratio (%) between 10 to 40, Z represents a molar ratio (%) between 20 to 80, and X+Y+Z=100 is satisfied.

4. The carrier of claim 3, wherein the resin in the coated layer comprises the copolymer including the structure having the formula (1) in an amount of from 3 to 90% by weight.

5. The carrier of claim 1, wherein the electroconductive layer of the filler has a thickness of from 0.1 to 0.6 μm.

6. The carrier of claim 1, wherein the substrate of the filler comprises aluminum oxide, barium sulfate or a titanium dioxide.

7. The carrier of claim 1, wherein the carrier has a bulk density of from 1.8 to 2.4 g/cm$^3$.

8. A two-component developer, comprising the carrier according to claim 1 and a toner.

9. An image forming method, comprising:

forming an electrostatic latent image on an electrostatic latent image bearer;

developing the electrostatic latent image with the two-component developer according to claim 8 to form a toner image;

transferring the toner image onto a recording medium; and fixing the toner image on the recording medium.

* * * * *